United States Patent [19]

Denu

[11] 4,179,754

[45] Dec. 25, 1979

[54] COMPETITION SWIMSUIT

[75] Inventor: Francis Denu, La Walk, France

[73] Assignee: ADIDAS, Fabrique de Chaussures de Sport, Landersheim, France

[21] Appl. No.: 854,679

[22] Filed: Nov. 25, 1977

[51] Int. Cl.[2] ..... A41D 5/00

[52] U.S. Cl. ..... 2/67

[58] Field of Search ..... 2/67, 2.1 R; 128/438

[56] References Cited

U.S. PATENT DOCUMENTS

| | | | |
|---|---|---|---|
| 1,868,741 | 7/1932 | Gassel | 2/67 |
| 1,944,482 | 1/1934 | Winship | 2/67 |
| 1,969,349 | 8/1934 | Bergh | 2/67 |
| 2,033,456 | 3/1936 | Cunningham | 2/67 |
| 2,343,607 | 3/1944 | Wrigley | 128/438 |
| 2,431,505 | 11/1947 | Reid | 2/67 |
| 2,749,551 | 6/1956 | Garbellano | 2/2.1 R |
| 3,436,762 | 4/1969 | Cahan | 2/67 |

*Primary Examiner*—Doris L. Troutman
*Attorney, Agent, or Firm*—Brisebois & Kruger

[57] ABSTRACT

A competition swimsuit for permitting air or water to escape from the region of the middle of the back of the swimmer. An upper portion of the back of the suit merely overlaps a lower portion of the back of the suit to provide a space through which air or water can escape.

2 Claims, 3 Drawing Figures

COMPETITION SWIMSUIT

The present invention has for an object a new competition swimsuit which is usable in particular by persons of the female sex.

For a long time, one has sought to improve the performances of competition swimmers by making improvements to swimsuits that they wear.

Thus particular fabrics have been conceived, and very shaped swimsuits have been made to obtain better hydrodynamic characteristics. Nevertheless most of the swimsuits actually manufactured which have a back, and in particular feminine swimsuits, have the disadvantage of giving rise to the formation of an air or water bubble which positions itself at the loins and which notably increases resistance to the advancement of the swimmer.

The present invention relates to a competition swimsuit which is of simple manufacture and which avoids the above mentioned disadvantage.

The present invention has as an object the new industrial product which constitutes a competition swimsuit, in particular for swimmers, which is characterized by the fact that the back of the suit is made in two parts which overlap partially near the waist leaving an unsewn space between them, the upper part of the back being positioned on top of the lower part of the back which it overlaps.

In one embodiment of the invention, the lower part of the back of the suit has the shape of conventional briefs or tights and ends along the waist. On the contrary, the upper part of the back of the suit ends toward the base in a concave arc of a circle whose ends descend, for example, as far as the thigh openings near the lateral stitching lines of the suit and whose midsection descends only slightly below the waist stitching line to insure the overlapping of the two parts forming the back of the suit conforming to the invention.

This particular shape has the advantage of allowing an excellent fit of the entire surface of the suit to the body of the swimmer.

In a preferred embodiment of the invention, the lower part of the back which is positioned below the waist is preferably made with a middle seam in order to fit this part of the suit perfectly to the anatomy of the person who wears it.

It is understood that conforming to the invention, near the waist there is an open passage between the two parts of the back which overlap, so that the air of water bubble which usually forms at the lines is automatically eliminated by a suction effect, the air or the water which make this bubble can escape to the outside of the suit by passing between the two parts which constitute the back of the suit.

In order to better understand the invention, an illustrative non-limiting embodiment will be described as an example and will be shown in the attached drawings.

Figure 1:
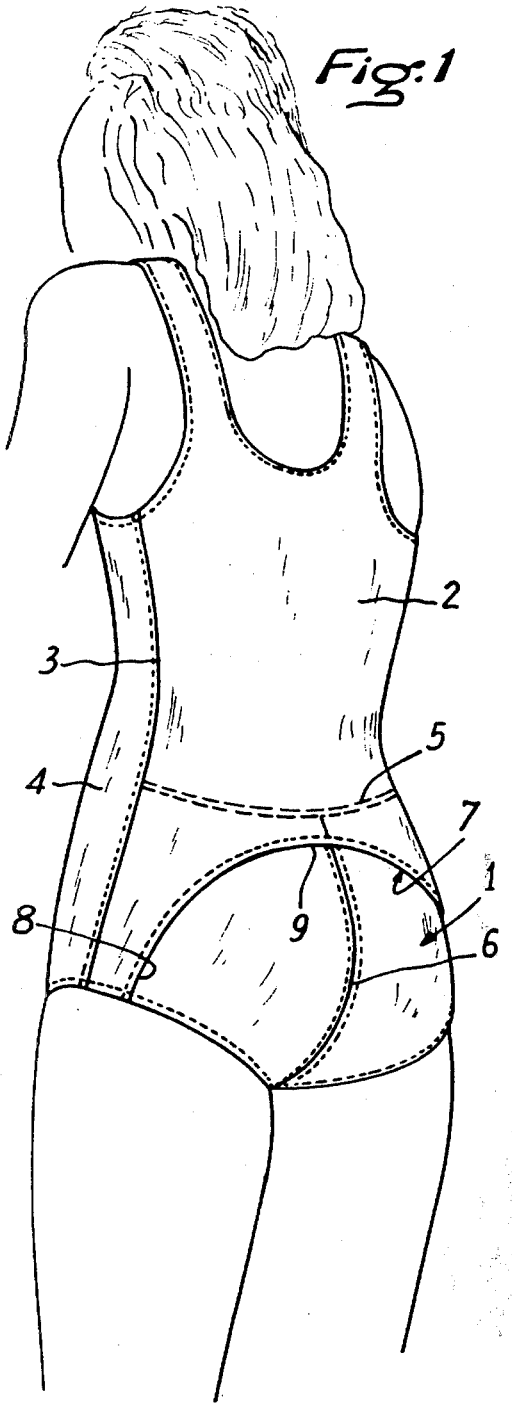
Figure 2:
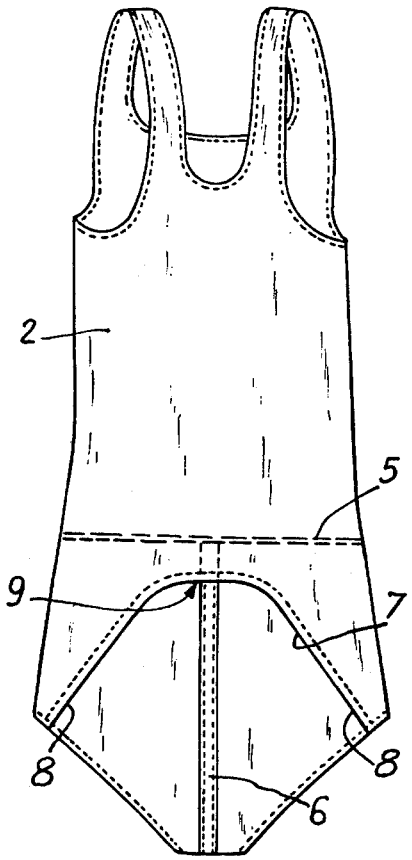
Figure 3:
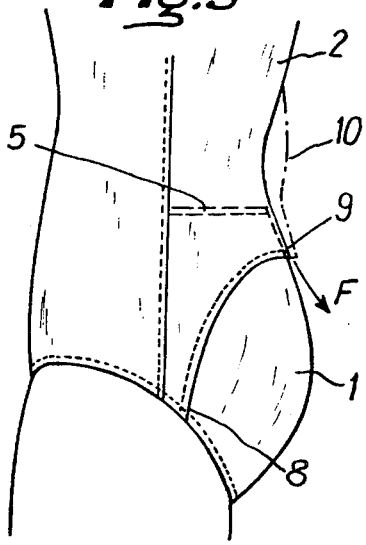

In these drawings:

FIG. 1 shows a view in perspective of a competition swimsuit conforming to the invention, FIG. 2 is a back view of the swimsuit of FIG. 1, and FIG. 3 is a side view of the swimsuit of FIG. 1.

One can see in the drawings how the back of the swimsuit is made of a lower part 1 and an upper part 2 which are joined by two side seams 3 to the front part 4 of the suit.

Lower part 1 is made like a brief or a panty going only to the waist at 5.

In the embodiment shown which is a preferred embodiment of the invention, the lower part 1 is made in two pieces so that seam 6 permits a better fit of the suit to the anatomy of the person who wears it.

The upper part 2 of the suit has a conventional shape near the top while its lower part has an arcuately curved hollow portion 7 whose ends 8 terminate at the thigh openings near side seams 3 and whose middle 9 is near but below waist 5.

The upper part 2 is only fastened to the lower part 1 along side semas 3 and to a small extent along the seams which encircle the thighs.

As a result, the rear parts 1 and 2 of the suit are not joined between themselves either at arcuately curved edge 7 or at edge 5 of the waist and there exists, because of this, a free passageway between the two parts of the suit in the waist area.

Consequently, in the event that an air or water pocket would form near the loins of the swimmer, this pocket would disappear automatically, the water or air passing between the two parts of the back of the suit by being drawn backwards by suction.

FIG. 3 shows in phantom lines how such a pocket which would tend to form would disappear by escaping in the direction of arrow F.

It is understood that the embodiment which has just been described has been given purely or the sake of illustration and is in no way limiting.

Particularly, it is clear that shape 7 of the lower margin of the lower part 1 of the back can be different from that which has been shown, what is essential, conforming to the invention, being to achieve at the back of the swimmer, an overlapping of the two parts of the suit which leaves between them a passageway permitting the evacuation of the water or air which can acucmulate near the loins.

Finally, although the invention has been described by referring to a competition swimsuit designed more particularly for swimming, it goes without saying that the suit can likewise be used by bathers who wish to wear a suit of this type.

I claim:

1. A competition swimsuit comprising in combination a front part, and a back fastened to the front part along side seams, said back comprising, a lower part extending over the seat of the person wearing the suit, and an upper part extending across and overlapping a portion of said lower part near the waist of the wearer, said upper part and lower part having an unconnected space between them through which air and water can escape from the upper part, and wherein said lower part of the back comprises a panty portion covering the seat of the wearer, having an upper end terminating along the waist, and defining the rear of thigh openings of the suit, and said upper part of the back includes a curved concave lower portion with tips extending to the thigh openings near the side seams.

2. A swimsuit according to claim 1 wherein the panty portion includes a middle seam to fit the panty portion to the seat of the wearer.

* * * * *